US007409174B2

(12) United States Patent
Tsurusaki

(10) Patent No.: US 7,409,174 B2
(45) Date of Patent: Aug. 5, 2008

(54) IMAGE FORMING APPARATUS FEATURING A TONER SUPPLY OPENING POSITIONED TO AVOID CONTAMINATION OF AN EXPOSURE SLIT

(75) Inventor: Teruaki Tsurusaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 193 days.

(21) Appl. No.: 11/270,473

(22) Filed: Nov. 10, 2005

(65) Prior Publication Data

US 2006/0104658 A1 May 18, 2006

(30) Foreign Application Priority Data

Nov. 12, 2004 (JP) ..... 2004-328677

(51) Int. Cl.
*G03G 21/00* (2006.01)

(52) U.S. Cl. ..... 399/98

(58) Field of Classification Search ..... 399/91–93, 399/98, 110, 111, 119, 224, 258, 262, 344–360
See application file for complete search history.

(56) References Cited

U.S. PATENT DOCUMENTS 5,210,573 A * 5/1993 Fukuchi et al. ..... 399/111
6,308,024 B1 * 10/2001 Nakayama et al. ..... 399/98
6,366,755 B1 * 4/2002 Takashima ..... 399/254
6,701,106 B2 * 3/2004 Yokoi et al. ..... 399/103
7,127,207 B2 * 10/2006 Tsurusaki ..... 399/359
2004/0265011 A1 * 12/2004 Tsuda et al. ..... 399/260

FOREIGN PATENT DOCUMENTS

JP 2002-311694 10/2002
JP 2002311694 A * 10/2002

* cited by examiner

*Primary Examiner*—David M. Gray
*Assistant Examiner*—Andrew V Do
(74) *Attorney, Agent, or Firm*—Fitzpatrick, Cella, Harper & Scinto

(57) ABSTRACT

An image forming apparatus includes a rotatable image bearing member; an exposure unit, disposed below the image bearing member, including a transmitting portion for transmitting a laser beam to which the image bearing member is exposed; a developing unit disposed above the exposure unit for developing, with toner, a electrostatic latent image formed on the image bearing member; and a toner supply opening for supplying toner into the developing unit above the exposure unit, wherein the toner supply opening is in a range, with respect to a rotation axial direction of image bearing member, inside an end of the exposure unit and outside the transmission portion.

6 Claims, 7 Drawing Sheets

(a)

(b)

IMAGE FORMING APPARATUS FEATURING A TONER SUPPLY OPENING POSITIONED TO AVOID CONTAMINATION OF AN EXPOSURE SLIT

FIELD OF THE INVENTION AND RELATED ART

The present invention relates to an image forming apparatus such as a copying machine, a laser printer, a facsimileing machine, etc., which employs an electrophotographic method for forming an image by developing a latent image formed on an image bearing member, with the use of a developing means and developer (which hereinafter will be referred to as toner).

An electrophotographic full-color image forming apparatus is such an image forming apparatus that forms a full-color image by depositing in layers toner images formed of four toners different in color, that is, yellow, magenta, cyan, and black toners. As one of the various types of this kind of an image forming apparatus, there is an image forming apparatus of the so-called tandem type, which has four photosensitive drums, four image forming portions having a developing apparatus and corresponding to the four photosensitive drums one for one, and an exposing apparatus. In operation, an image is formed on each of the four photosensitive drums, and then, the four images are deposited in layers on a sheet of recording medium to yield a full-color image.

The aforementioned image forming apparatus of the tandem type is problematic in that it is large in component count, being therefore likely to be large in size. Therefore, in some of the full-color image forming apparatuses of the tandem type, an image writing apparatus is disposed on the underside of the space occupied by the photosensitive drums, for the purpose of size reduction, exposing the photosensitive drums across their undersides.

In the case of an image forming apparatus, the photosensitive drums of which are exposed across their undersides, toner is likely to adhere to the exposing apparatus for exposing the photosensitive drums. Therefore, the exposure beam projection windows (which hereinafter will be referred to simply as exposure slits) of the exposing apparatuses of some of the image forming apparatuses of this type are provided with a dust shield formed of a plate of glass or the like. However, even if the exposure slits are provided with a plate of glass as a dust shield, the toner which happens to fall from the developing apparatuses and/or a toner supplying apparatus will land on the exposing apparatus, contaminating thereby the surface of the plate of glass as a dust shield. As a result, the laser beam projection is interfered with by the contaminated plate of glass, which results in the formation of a defective image.

Thus, the structural arrangement shown in FIG. 8 has been disclosed in Japanese Laid-open Patent Application 2002-311694. That is, in order to prevent toner from accumulating on the surface of the portion 102 of the glass of the exposing apparatus 100, the exposing apparatus 100 is structured so that the direction, in which the image writing beam of light is projected toward the photosensitive drums, is diagonally upward relative the top surface of the exposing apparatus 100, which is different by a certain angle from the conventional direction, that is, the vertically upward direction relative to the top surface of the exposing apparatus 100, and further, the portion 102 of the glass of the exposing apparatus 100, through which the beam of light is projected, is rendered vertical so that not only is the amount by which toner lands per unit area of the surface of the portion 102, but also, toner will slide down due to its own weight as it lands on the surface of the portion 102 of the glass.

FIG. 9 shows an electrophotographic image forming apparatus which employs process cartridges 104 having a photosensitive drum for forming an image by receiving toner from a corresponding toner cartridge 103, and in which the photosensitive drums are exposed across the underside thereof. As one of the means for preventing the actual image writing area 106 of the exposing apparatus 100 from being contaminated by such toner that scatters and/or falls from the toner outlet 105, it is possible to provide the image forming apparatus with a separation wall 107 which keeps the space for the process cartridges 104 separated from the space for the exposing apparatus 100. In such a case, however, the separation wall 107 must be provided with slits 108 for allowing the image writing beam of laser light projected from the exposing apparatus 100 to reach the photosensitive drums in the process cartridges 104. Therefore, it is impossible to completely separate the space for the process cartridges 104 from the space for the exposing apparatus 100. As for the countermeasure for this problem, it is possible to provide the image forming apparatus with a shutter 109 as a dust shield for keeping covered the aforementioned image writing area 106 of the exposing apparatus 100, except for during exposure.

The length of the service life of the process cartridge 104 is determined by the length of the service lives of the photosensitive drum and toner, which the process cartridge has. Thus, the process cartridge 104 is designed to be shorter in the length of service life than the main assembly of the image forming apparatus. Therefore, it is common practice to structure the process cartridge 104 so that it can be replaced: it is structured so that it can be easily mounted into, or removed from, the main assembly of the image forming apparatus.

After the mounting of the process cartridge 104 into the main assembly of the image forming apparatus, it is kept held between the lateral plates 110, which are located on the front and rear sides, or left and right sides, of the main assembly. Therefore, it has to be on the inward side of the lateral plates 110 where the toner outlet 105 are located. Hence, it is possible to provide the image forming apparatus main assembly with a separation wall 111, which is positioned on the inward side of one of the lateral plates 110, in order to prevent toner from falling onto the image writing area of the exposing apparatus 100. However, the separation wall 111 must be provided with holes 112 through which the process cartridges 104 are mounted or removed.

Evidently, the above described structural arrangements are for preventing toner from falling onto the exposure slits through which the image writing beams of laser light are projected. However, as image forming apparatuses are reduced in size, the distance (in terms of secondary scan direction) between the adjacent two exposure slits through which adjacent two photosensitive drums are exposed is also reduced. This increases the possibility that toner adheres to the exposure slits, in spite of the provision of the aforementioned shutters as dust (toner) shields. In addition, it is possible that even if the shutters are provided, the toner having adhered to the shutters will transfer onto the glass or the like through which the image writing beams of laser light are projected. In other words, this solution is also not perfect.

SUMMARY OF THE INVENTION

The primary object of the present invention is to provide an image forming apparatus which has multiple image bearing members, and in which the exposure slits through which an image writing beam of laser light is projected onto the image bearing members are not contaminated by the falling toner, in spite of the small distance between the adjacent two exposure slits.

According to an aspect of the present invention, there is provided an image forming apparatus comprising an image bearing member; developing means for developing, with toner, an electrostatic latent image formed on the image bearing member; exposure means, disposed below the image bearing member, having an exposure opening for exposing the image bearing member to scanning light; and toner supply means for supplying toner into the developing means through a toner supply opening, wherein the toner supply opening is disposed outside the exposure opening with respect to a scanning direction of the scanning light.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be concretely described.

Embodiment 1

{General Structure of Image Forming Apparatus}

Figure 1:
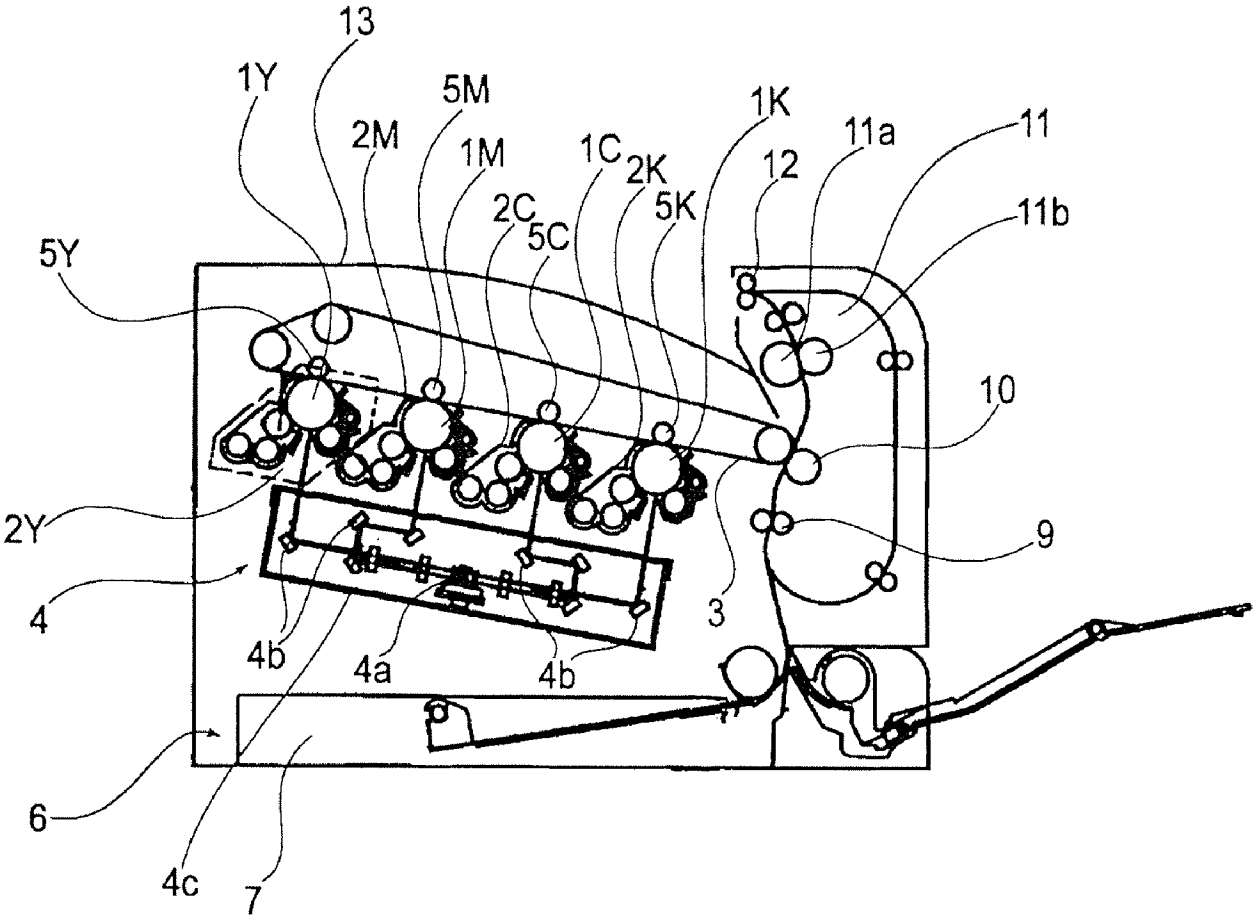
FIG. 1 is a schematic sectional view of the image forming apparatus in the first embodiment of the present invention, showing the general structure thereof.

First, referring to FIG. 1, the general structure of the image forming apparatus will be described. In the image forming apparatus shown in FIG. 1, four photosensitive drums 1 (1Y, 1M, 1C, and 1K), as image bearing members, on which toner images of yellow, magenta, cyan, and black color, respectively, are disposed. In the adjacencies of the peripheral surface of each photosensitive drum 1, a charging means, a developing means, and a cleaning means are disposed in a manner of surrounding the peripheral surface of the photosensitive drum: The photosensitive drum 1 and these processing means are placed in a cartridge, making up a process cartridge 2 (2Y, 2M, 2C, or 2K) as an image forming unit. Disposed in the space above the space occupied by the process cartridges 2, in contact with each of the photosensitive drums 1, is an intermediary transfer belt 3 as an example of an intermediary transfer member in the form of a belt.

Further, disposed vertically below the space occupied by the process cartridges 2 is an exposing means 4, which projects a beam of laser light, while modulating it with video signals, to selectively expose the numerous points on the peripheral surface of each of the photosensitive drums 1. The exposing apparatus 4 is made up of: a light emitting member which emits a beam of laser light in response to video signals; a polygon mirror 4*a* for oscillating the beam of laser light in the lengthwise direction (primary can direction) of each photosensitive drum 1; various lenses; mirrors 4*b* for reflecting the beam of laser light to project it toward each photosensitive drum 1; etc.: these components are enclosed in a housing 4*c* provided with four exposure slits through which the beam of laser light is projected onto each photosensitive drum 1.

The photosensitive drums 1 are charged by the corresponding charging means, and are exposed to optical images corresponding to four primary colors, that is, yellow, magenta, cyan, and black colors, with which a full-color image is to be formed. As a result, latent images corresponding to the yellow, magenta, cyan, and black colors are formed on the photosensitive drums 1, one for one. Then, the latent images are developed by the corresponding developing means, which use toner, forming thereby visible images of yellow, magenta, cyan, and black toners (which hereinafter will be referred to as toner images), on the peripheral surfaces of the photosensitive drums 1.

As each photosensitive drum 1 is rotated, the toner image thereon reaches the primary transfer portion where the photosensitive drum 1 is in contact with the intermediary transfer belt 3. In the primary transfer portion, the toner image is transferred onto the intermediary belt 3, in a manner of being rolled out onto the belt 3 from the photosensitive drum, by a primary transfer roller 5 (5Y, 5M, 5C, or 5K) positioned in a manner of opposing the photosensitive drum 1.

Meanwhile, sheets of recording mediums stored in a sheet feeder cassette 7 loaded in the bottom portion of the apparatus main assembly 6 are sent out of the cassette 7, one by one, into the main assembly 6, in synchronism with the progression of the aforementioned toner image formation, and then, are conveyed to the secondary transfer portion while being controlled by a pair of registration rollers 9 in terms of the timing with which they arrive at the secondary transfer portion. In the secondary transfer portion, a secondary transfer roller 10 as a secondary transferring means is disposed in contact with the intermediary transfer belt 3, being thereby rotated by the movement of the transfer belt 3. While the sheet of recording medium is conveyed through the secondary transfer portion, bias is applied to the secondary transfer roller 10. As a result, the toner images on the intermediary transfer belt 3 are transferred (secondary transfer) all at once onto the sheet of recording medium.

After the transfer of the toner images onto the sheet of recording medium, the sheet is conveyed to a fixing means 11, which is made up of a heat roller 11*a* and a pressure roller 11*b*. In the fixing means 11, the sheet and the toner images thereon are subjected to heat and pressure. As a result, the toner images are fixed to the sheet; while the sheet and the toner images thereon are subjected to heat and pressure, the toners of which the toner images are formed, and which are different in color, are welded (fixed) to the sheet while being mixed. As a result, a full-color image is yielded on the sheet of recording medium; a color print is yielded. After the fixation of the toner images, the sheet of recording medium is discharged into a delivery tray 13 as a sheet catching portion, by a pair of sheet discharge rollers 12 positioned on the downstream side of the fixing means 11.

Listing in the bottom-to-top direction of the apparatus main assembly 6 of the image forming apparatus in this embodiment, structured as described above, the abovementioned components are positioned in the order of: the sheet feeder cassette 7, exposing means 4, process cartridges 2, intermediary transfer belt 3, and delivery tray 13. Further, the sheet conveyance passage is structured so that sheets are conveyed in the bottom-to-top direction.

Further, each of the process cartridges 2 is removably mounted in the apparatus main assembly 6, so that it can be replaced as necessary, for example, as the service life of the photosensitive drum 1 expires.

{Structural Arrangement for Supplying Main Assembly with Toner}

The image forming apparatus in this embodiment is structured so that the developing means of each process cartridge 2 can be supplied with the toner through a toner hopper as a toner supplying means. At this time, the structural arrangement for supplying the developing apparatus with toner will be described.

Figure 2:
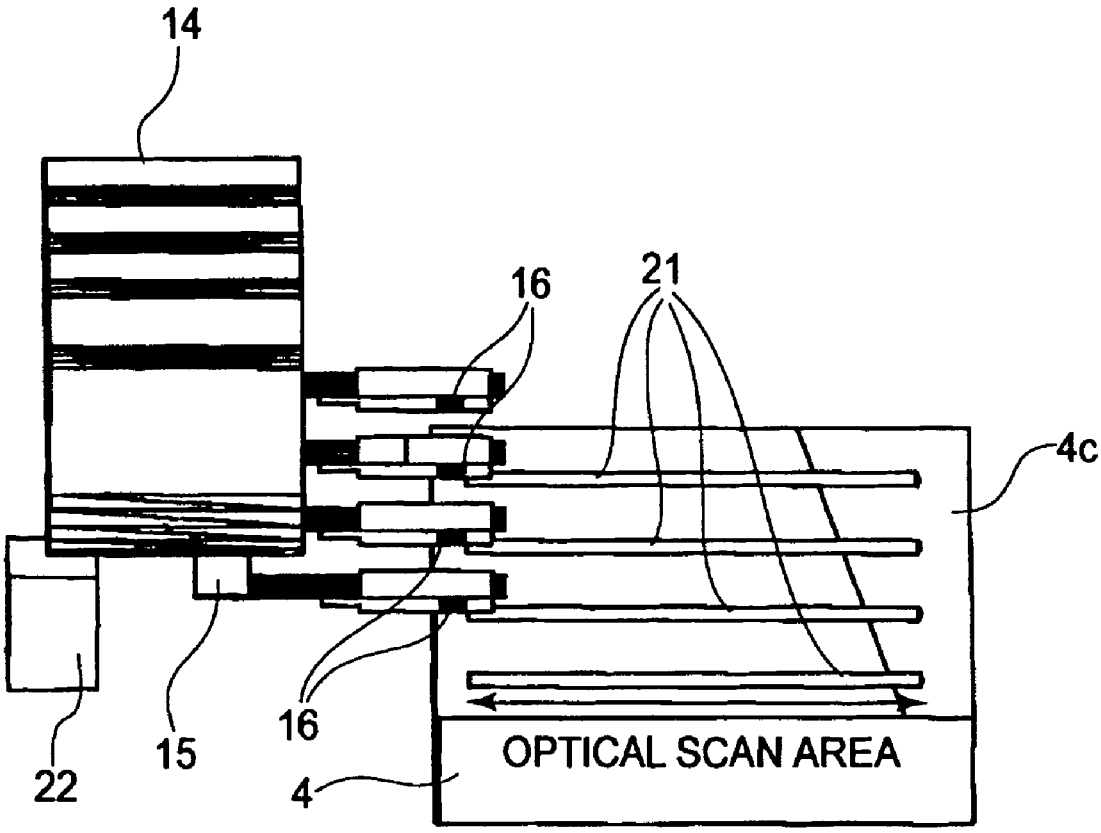
FIG. 2 is a schematic drawing showing the positional relationship between the toner outlets and the exposure slits of the exposing means.
Figure 3:
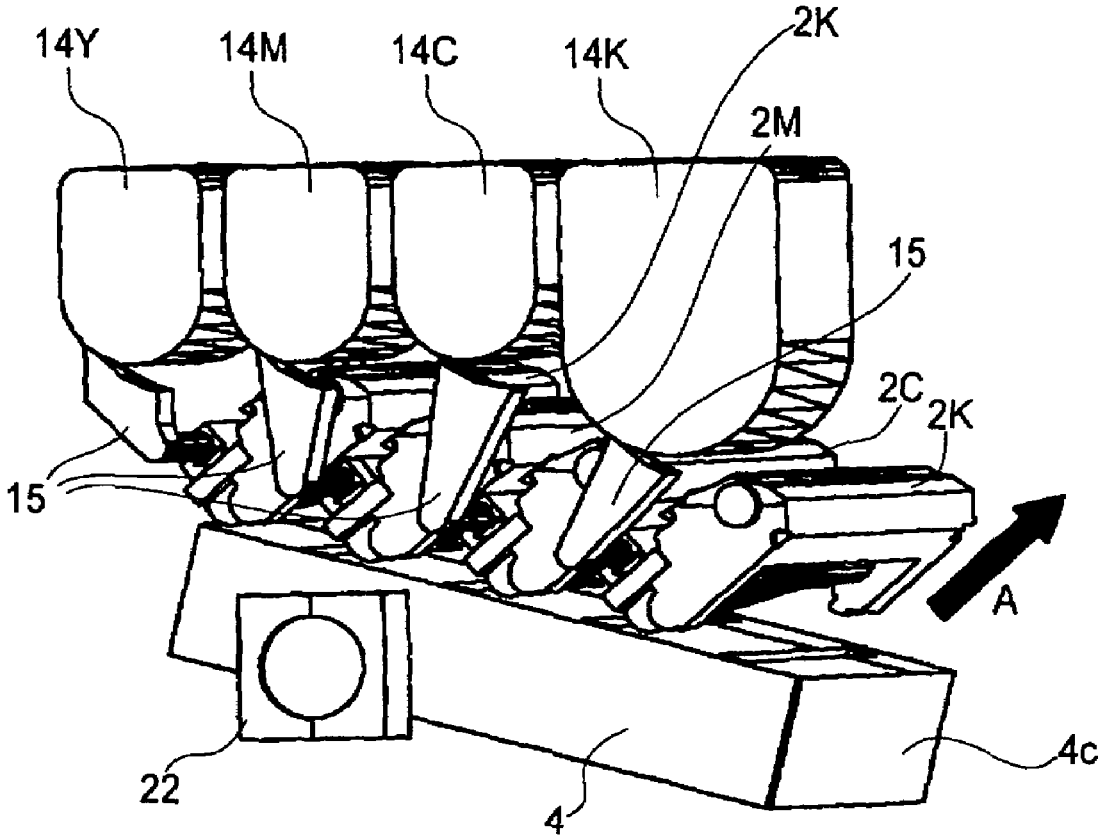
FIG. 3 is a perspective view of the exposing means, process cartridges, and toner hoppers, showing the relationship thereof.

Referring to FIGS. 2 and 3, toner cartridges 14 (14Y, 14M, 14C, and 14K) filled with yellow, magenta, cyan, and black toners, respectively, are disposed next to the process cartridges 2 (2Y, 2M, 2C, and 2K), respectively. The apparatus main assembly 6 is structured so that the toner in each of the toner cartridges 14 is supplied to the developing means in the corresponding process cartridge 2 by the corresponding hopper 15.

Figure 4:
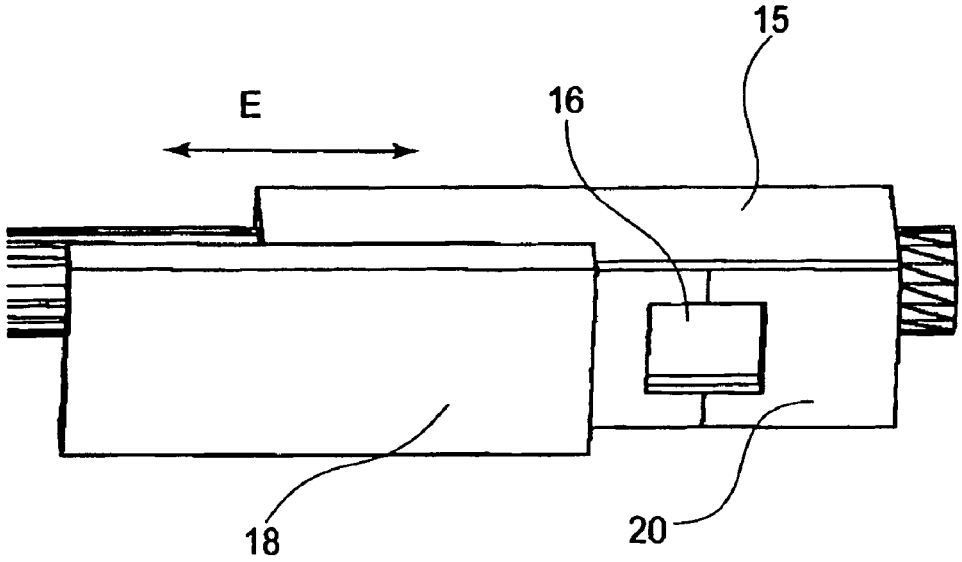
FIG. 4 is a schematic drawing of the shutter for the toner outlet and the shutter for the toner inlet.
Figure 4:
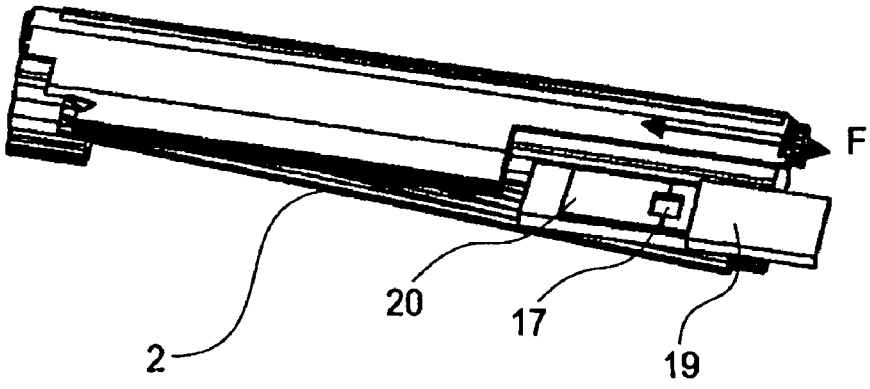

Referring to FIG. 4(*a*), each hopper 15 is provided with a toner outlet 16 through which toner is supplied to the corresponding process cartridge 2. Next, referring to FIG. 4(*b*), each process cartridge 2 is provided with a toner inlet 17 through which the toner from the toner outlet 16 is received by the process cartridge 2. Each of the process cartridges 2 is removably mountable in the apparatus main assembly 6, and receives the toner which the developing means thereof uses for image formation, from the hopper 15 through the toner outlet 16 and toner inlet 17.

Thus, for the purpose of preventing the leaking of the toner from the toner outlet 16 and toner inlet 17, which will result in the contamination of the interior of the image forming apparatus, the toner outlet 16 and toner inlet 17 are provided with shutters 18 and 19, respectively, which are opened or closed in the directions indicated by referential marks E and F, respectively, in FIG. 4. When removing any of the process cartridges 2 from the apparatus main assembly 6, the corresponding shutters 18 and 19 are moved in the direction to close the toner outlet 16 and toner inlet 17, sealing thereby the toner outlet 16 and toner inlet 17, respectively.

In this embodiment, an elastic member 20 formed of MOLTOPREN or the like is sandwiched between the shutter 18 and toner outlet 16, and between the shutter 19 and toner inlet 17, better sealing the toner outlet 16 and toner inlet 17.

As for the structural arrangements for opening or closing the shutters 18 and 19, they may be such that a user is to open or close them when the user mounts or removes the process cartridges 2, or that they are automatically opened or closed by the movement of the driving apparatus, such as a motor, for driving the process cartridges 2.

Also in this embodiment, the hoppers 15 are disposed on the user side (front side) of the space for the process cartridges 2, as shown in FIG. 3, reducing thereby the size of the cross section of the apparatus main assembly 6, as seen from the front side (user side in FIG. 1), and therefore, reducing the image forming apparatus in overall size. Further, the apparatus main assembly 6 is structured so that the process cartridges 2 are to be mounted into the apparatus main assembly 6 from the top side, in the diagonal direction indicated by an arrow mark A in FIG. 3.

It is possible to position the hoppers 15 in the space above the space in which the process cartridges 2 are disposed, so that the process cartridges 2 can be inserted into, or removed from, the apparatus main assembly 6, from the front side of the apparatus main assembly 6. However, from the standpoint of reducing the image forming apparatus in terms of the cross section as seen from the front side, the structural arrangement employed in this embodiment is more effective.

(Positional Relationship between Toner Outlet and Exposure Slits)

The problem that toner falls from the toner outlets 16 can be prevented by closing the shutters as described above. However, it is unrealistic to expect that the fall of toner can be completely prevented throughout the duration of the service life of the image forming apparatus. In other words, at some point during the service life of the image forming apparatus, toner will fall and adhere to the mirrors or the like components of the exposing means 4, and the adhesion of the toner thereto will reduce the image forming apparatus in the level of quality at which it forms an image.

In this embodiment, therefore, the polygon mirror or the like of the exposing means 4 are disposed in the housing 4*c*, which is provided with exposure slits 21 through which the photosensitive drums 1 are scanned by the beam of laser light (FIG. 2), as described above; the beam of laser light is projected onto the photosensitive drums through these slits. In other words, the amount by which toner adheres to the mirror or the like of the exposing means 4 is minimized by placing them in the housing 4*c*.

Figure 5:
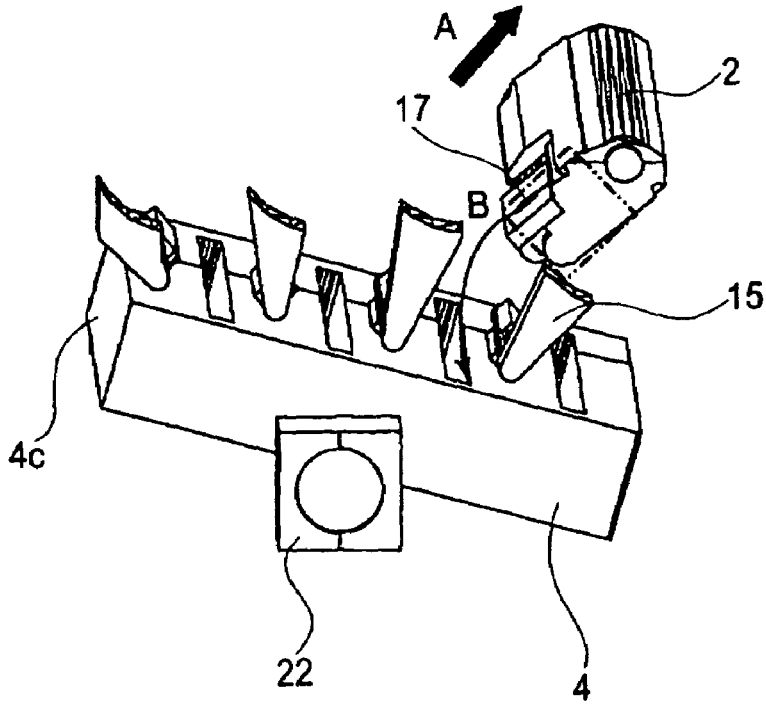
FIG. 5 is a drawing showing the falling of toner, which occurs when the process cartridge is pulled out of the image forming apparatus main assembly.

Also in this embodiment, the apparatus main assembly 6 is structured so that when removing the process cartridges 2 from the apparatus main assembly 6, the cartridges 2 are to be pulled in the diagonally upward direction indicated by an arrow mark A in FIG. 5, and also, so that the aforementioned toner outlet shutter and toner inlet shutter are closed by this pulling of the process cartridges 2 in the diagonally upward direction.

However, it is possible that when the process cartridges 2 are mounted or removed, toner will fall onto the exposure slits 21 of the exposing means 4. It is also possible that the adjacencies of the toner inlet 17 of a process cartridge 2 is sometimes contaminated, in particular, after the occurrence of an accident. In such a case, it is possible that during the operation of extracting a process cartridge 2, toner will be accidentally allowed to fall onto the top surface of the exposing means 4, in the direction indicated by an arrow mark B in FIG. 5.

Therefore, as shown in FIG. 2, the image forming apparatus in this embodiment is structured so that the toner outlets 16 (and toner inlets 17) are positioned outside the range in which the photosensitive drums are scanned (outside the range of each exposure slit 21) in terms of the primary scan direction by the exposing means 4. Therefore, the process of supplying the developing means with the toner from the toner outlet 16 occurs outside the range of the exposure slit 21. Therefore, it does not occur that the exposure slit portions of the exposing means are contaminated with toner when a process cartridge 2 is extracted.

Incidentally, the image forming apparatus in this embodiment is structured so that for the purpose of mounting the process cartridges 2 into the apparatus main assembly 6, or removing them therefrom, they are to be inserted in the diagonally downward direction, or pulled in the diagonally upward direction, respectively. However, an image forming apparatus may be structured so that for the purpose of mounting the process cartridges into the apparatus main assembly 6, and removing them therefrom, they are to be inserted from the front side of the apparatus main assembly 6, shown in FIG. 1, and to be pulled out toward the front side, respectively, or so that the process cartridges 2 are to be mounted and removed in the left to right direction, and right to left direction, respectively, of FIG. 1. In other words, as long as the image forming apparatus is structured so that the toner outlets 16 and toner inlets 17 are positioned outside the ranges of the exposure slits 21 of the exposing means 4, in terms of the primary scan direction of the exposing means 4, the possibility that toner will fall onto the exposure slit areas of the exposing means 4 can be reduced.

In this embodiment, the image forming apparatus is structured so that the toner inlets are positioned outside the range of the exposure slits in terms of the primary scan direction of the exposing means. Further, the positional relationship between a toner inlet and the corresponding image bearing member is such that they are aligned in the direction parallel to the secondary scan direction of the exposing means. Therefore, even if toner leaks from the toner inlet, the image bearing member is not affected.

{Means for Generating Air Flow}

The image forming apparatus in this embodiment is provided with a fan 22, as a means for generating air flow, which is disposed in the apparatus main assembly. Not only is this fan 22 is given the function of cooling the interior of the apparatus main assembly, but also, the function of generating such air flow that prevents the toner having fallen from the toner outlets 16, from contaminating the exposure slit areas of the exposing means 4.

Figure 6:
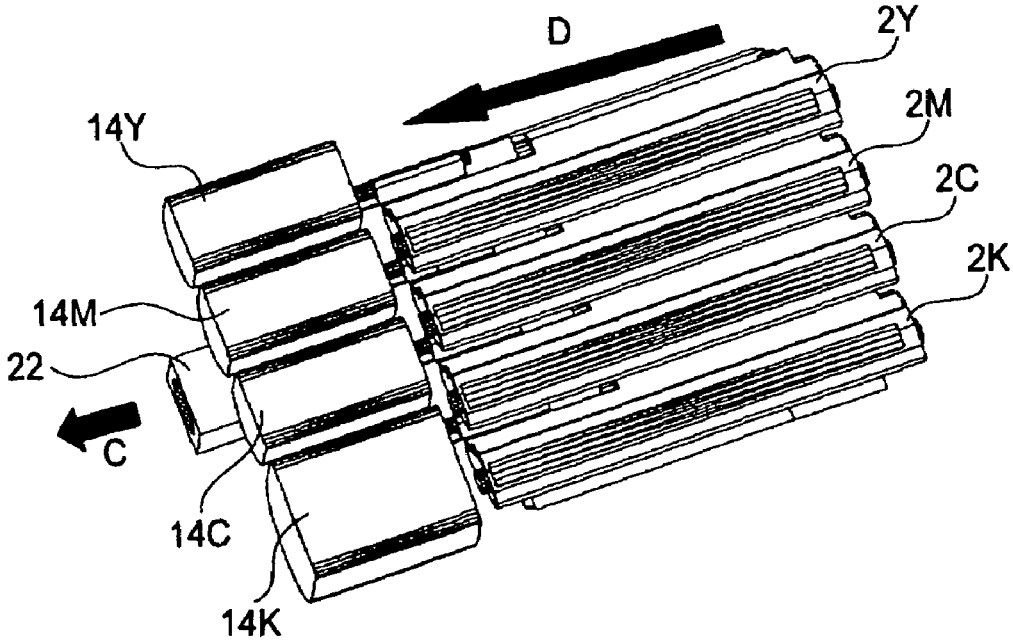
FIG. 6 is a drawing showing the air flow in the image forming apparatus main assembly.

In other words, the fan 22 is driven to generate air flow in the direction indicated by an arrow mark C in FIG. 6, not only functioning to exhausting the internal air of the apparatus main assembly in order to cool the interior of the apparatus main assembly, but also, causing the air in the adjacencies of the process cartridges 2 to flow in the direction indicated by an arrow mark D in the drawing. With the provision of this setup, the fan 22 generate such air flow that flows from the exposure slit side of the exposing means 4 toward the toner outlet side.

Figure 7:
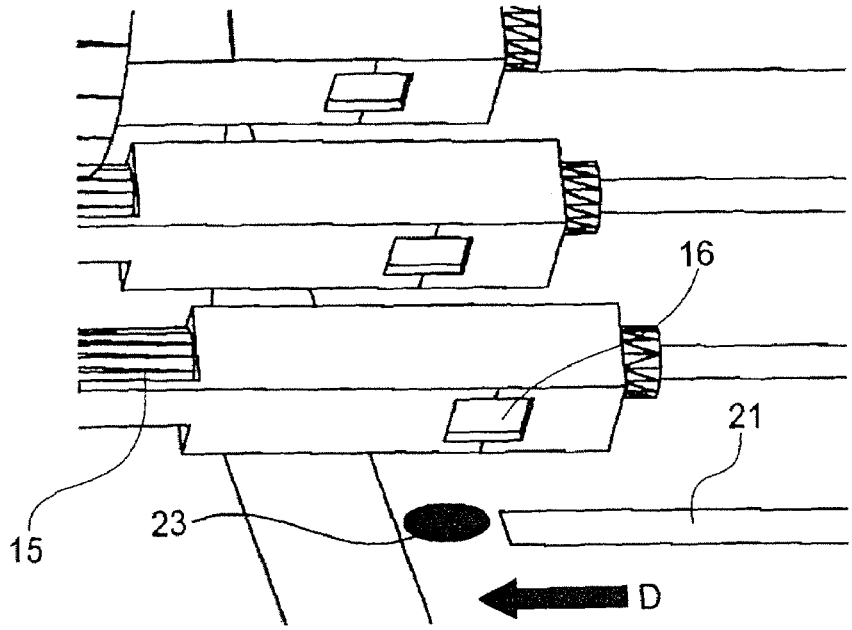
FIG. 7 is a drawing showing the state of the toner having fallen from the toner outlet.
Figure 8:
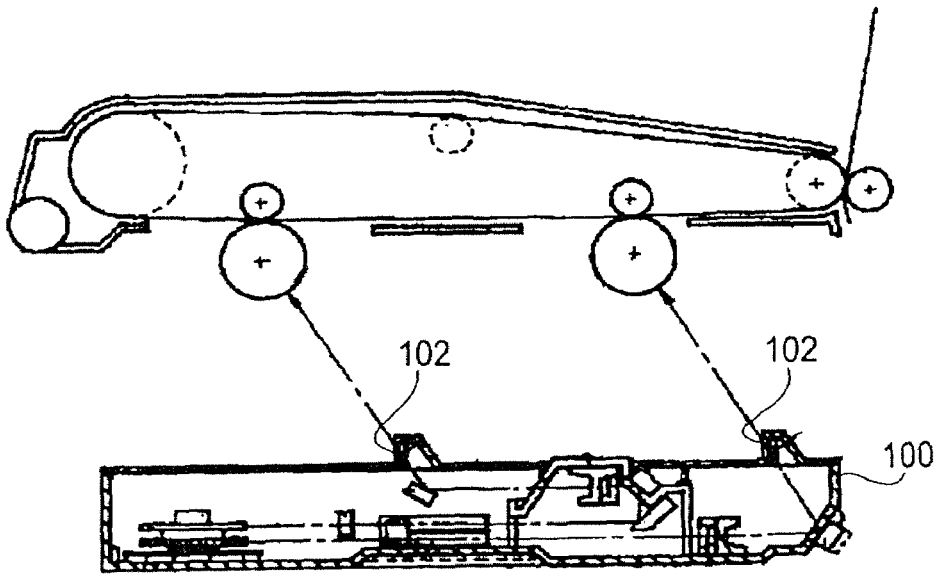
FIG.8 Prior Art
FIG. 8 is a schematic sectional view of a typical image forming apparatus in accordance with the prior art.
Figure 9:
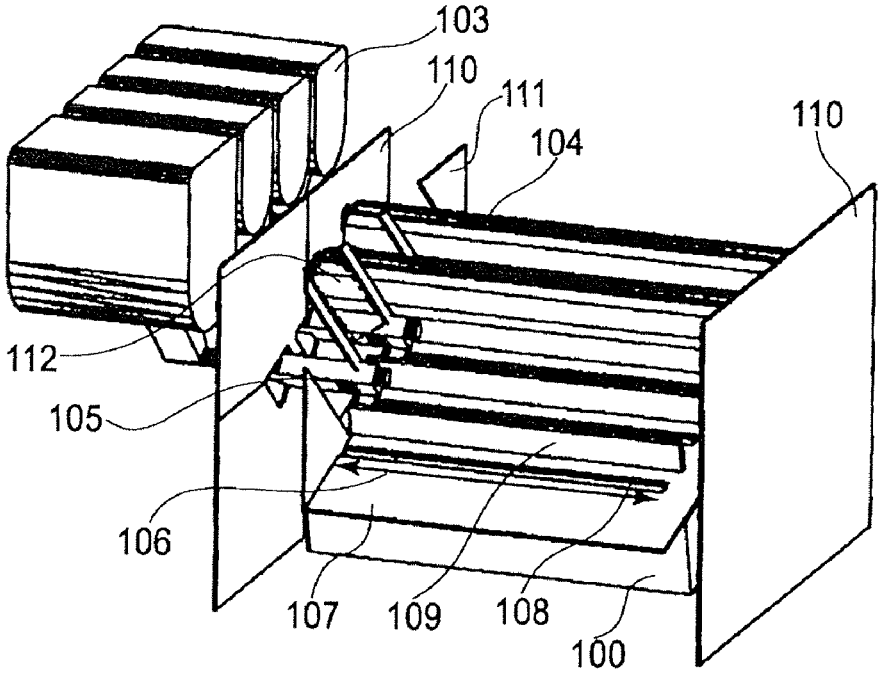
FIG.9 Prior Art
FIG. 9 is a schematic perspective view of a typical image forming apparatus in accordance with the prior art.

Therefore, even if toner 23 falls from the toner outlet 16, or the toner inlet of a process cartridge, toward the exposing means 4, as shown in FIG. 7, when a process cartridge is extracted, the portion of the exposing means 4, onto which the toner 23 will fall, is outside the range of the exposure slit 21, and further, the toner 23 is blown by the above described air flow in the direction opposite to the exposure slit 21. Thus, the toner 23 flies away toward the image forming portion, that is, the portion outside the range of the exposure slit 21, being thereby prevented from contaminating the components such as the photosensitive drums, and the exposing slit areas of the exposing means, which are essential to image formation. Therefore, it is possible to prevent the formation of an image suffering from the defect attributable to the scattering of toner in the image forming apparatus. Therefore, the image forming apparatus can be satisfactorily used until the end of the designed service life thereof.

Incidentally, an image forming apparatus may be provided with ducts as air passages, and/or walls for forming air passage, in order to effectively create such air flow as the above described one in the apparatus main assembly. However, toner can be removed without the provision of components dedicated to the creation of air flow.

As will be evident from the description of this embodiment given above, by structuring and positioning the toner outlets 16 as described above, and with the provision of a means for creating air flow, a small and inexpensive image forming apparatus, which does not form an image suffering from the image defects attributable to the scattering and/or falling of toner in the image forming apparatus, can be provided without the need for changing the angle, at which the image writing beam of laser light is projected, to such an angle that imposes a substantial amount of constraint on the positioning and structuring of the components of the image forming apparatus.

[Additional Embodiments]

In the above described embodiment, the housing 4*c* of the exposing means 4 is provided with the slits through which the image writing beam of laser light is projected. These slits may be provided with a dust shield formed of transparent glass or the like. Such an arrangement can better prevent the exposing means from being contaminated by toner. Further, the housing 4*c* may be provided with dust shutters which can expose or hide the slits.

Also in the above described embodiment, the image forming apparatus was a full-color image forming apparatus in which four process cartridges are mounted. However, not only is the method of positioning the toner outlets and the exposure slits of the exposing means, in the above described relationship, effective to prevent the above described contamination by toner, from occurring in the image forming apparatus in the above described embodiment, but also, it is effective to prevent the above described contamination by toner, from occurring in such an image forming apparatus as a monochromatic image forming apparatus which employs only one process cartridge, as well as such an image forming apparatus that employs five or more process cartridges.

Further, in the above described embodiment, the image forming apparatus employed process cartridges in which a photosensitive drum and a developing means were integrally disposed. However, the present invention is also effectively applicable to an image forming apparatus, only the developing means of which are exchangeable, whereas the photosensitive drums of which are permanently left in its main assembly.

Also in the above described embodiment, a fan was employed as an air flow generating means, for functional efficiency as well as cost efficiency. However, the air flow generating means does not need to be limited to a fan. That is, any apparatus will suffices as long as it effectively generates air flow.

According to the present invention, an image forming apparatus is structured so that the process of discharging toner from a toner outlet into a developing means occurs outside the range of an exposure slit. Therefore, it is possible to prevent the exposure slit and its adjacencies from being contaminated by the toner having fallen from the toner outlet, without employing a complicated mechanism.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 328677/2004 filed Nov. 12, 2004 which is hereby incorporated by reference.

What is claimed is:

1. An image forming apparatus comprising:

a rotatable image bearing member;

an exposure unit, disposed below said image bearing member, including a transmitting portion for transmitting a laser beam to which said image bearing member is exposed;

a developing unit disposed above said exposure unit for developing, with toner, an electrostatic latent image formed on said image bearing member, wherein said developing unit is upwardly removable from the image forming apparatus; and a toner supply opening for supplying toner into said developing unit above said exposure unit, wherein said toner supply opening is in a range, with respect to a rotational axial direction of said image bearing member, inside an end of said exposure unit and outside said transmitting portion.

2. An apparatus according to claim 1, further comprising airflow producing means for forming an airflow toward one end of said transmitting portion where said toner supply opening is provided from the other end of said transmitting portion.

3. An apparatus according to claim 2, wherein said airflow producing means includes a fan.

4. An apparatus according to claim 1, further comprising a toner container disposed proximate to said toner supply opening and juxtaposed relative to said developing unit in the rotational axial direction of said image bearing member.

5. An apparatus according to claim 1, further comprising a first shutter for opening and closing said toner supply opening, wherein said developing unit includes an opening portion, and said developing unit is provided with a second shutter for opening and closing said toner supply opening.

6. An apparatus according to claim 1, further comprising:

a second image bearing member, a second developing unit for developing an electrostatic latent image formed on said second image bearing member;

a second transmitting portion for transmitting a laser beam to which said second image bearing member is exposed, wherein said exposure unit includes said second transmitting portion; and a second toner supply opening for supplying toner into said developing unit above said exposure unit, wherein said second toner supply opening is in a range, with respect to a rotational axial direction of said second image bearing member, inside an end of said second exposure unit and outside said second transmitting portion.

* * * * *

UNITED STATES PATENT AND TRADEMARK OFFICE

CERTIFICATE OF CORRECTION

PATENT NO. : 7,409,174 B2
APPLICATION NO. : 11/270473
DATED : August 5, 2008
INVENTOR(S) : Teruaki Tsurusaki It is certified that error appears in the above-identified patent and that said Letters Patent is hereby corrected as shown below:

ON THE TITLE PAGE:

At Item (57), Abstract, line 6, “a” should read --an--.

COLUMN 1:

Line 10, “facsimileing” should read --facsimile--.
Line 61, “relative” should read --relative to--.

COLUMN 2:

Line 48, “above described” should read --above-described--.

COLUMN 4:

Line 17, “etc.:” should read --etc.;--.

COLUMN 7:

Line 53, “above described” should read --above-described--.
Line 67, “above” should read --above- --.

UNITED STATES PATENT AND TRADEMARK OFFICE

CERTIFICATE OF CORRECTION

PATENT NO. : 7,409,174 B2
APPLICATION NO. : 11/270473
DATED : August 5, 2008
INVENTOR(S) : Teruaki Tsurusaki It is certified that error appears in the above-identified patent and that said Letters Patent is hereby corrected as shown below:

COLUMN 8:

Line 18, “above described” should read --above-described--.
Line 25, “above described” should read --above-described--.
Line 29, “above described” should read --above-described--.
Line 30, “above described” should read --above-described--.
Line 32, “above described” should read --above-described--.
Line 33, “above described” should read --above-described--.
Line 38, “above described” should read --above-described--.
Line 46, “above described” should read --above-described--.

Signed and Sealed this

Third Day of March, 2009

JOHN DOLL
*Acting Director of the United States Patent and Trademark Office*